United States Patent [19]

Fink et al.

[11] Patent Number: 4,799,624

[45] Date of Patent: Jan. 24, 1989

[54] SPRAY HEAD HAVING FLUID METERING SCREWS

[75] Inventors: Roland Fink, Winterbach; Walter Klingenstein, Urbach, both of Fed. Rep. of Germany

[73] Assignee: Oskar Frech GmbH & Co., Schorndorf-Weiler, Fed. Rep. of Germany

[21] Appl. No.: 126,934

[22] Filed: Nov. 30, 1987

[30] Foreign Application Priority Data

Dec. 23, 1986 [DE] Fed. Rep. of Germany ..... 3644184

[51] Int. Cl.[4] ..... B05B 7/12

[52] U.S. Cl. ..... 239/412; 239/416.4; 239/417.3

[58] Field of Search ..... 239/412, 413, 416.4, 239/417.3, 600

[56] References Cited

U.S. PATENT DOCUMENTS

| | | | |
|---|---|---|---|
| 1,277,905 | 9/1918 | Gilbert | 239/413 |
| 2,536,832 | 1/1951 | Altorfer | 239/600 |
| 2,732,258 | 1/1956 | Fisher | 239/600 |
| 3,057,273 | 10/1962 | Wilson | 239/413 |

FOREIGN PATENT DOCUMENTS

| | | | |
|---|---|---|---|
| 0041975 | 3/1985 | European Pat. Off. . | |
| 1077582 | 9/1960 | Fed. Rep. of Germany . | |
| 2157710 | 7/1972 | Fed. Rep. of Germany . | |
| 2657533 | 6/1977 | Fed. Rep. of Germany . | |
| 3238201 | 6/1984 | Fed. Rep. of Germany | 239/413 |
| 3604147 | 8/1986 | Fed. Rep. of Germany . | |

*Primary Examiner*—Andres Kashnikow
*Assistant Examiner*—Michael J. Forman
*Attorney, Agent, or Firm*—Burns, Doane, Swecker & Mathis

[57] ABSTRACT

A spray head includes a nozzle body having a front side, a rear side and internal passages for conducting fluid. The passages include inlet ports arranged in the rear side to which fluids are supplied. A spray nozzle is mounted on the front side. Metering screws are mounted in the nozzle body for controlling the volume of fluids supplied to the nozzle. Those metering screws are exposed for adjustment in the front side of the nozzle body. The spray nozzle may comprise a flexible tube, or may include a ball-shaped mounting portion which is rotatably mounted in a removable nozzle holder. Support screws for mounting the spray head to a support structure are exposed for actuation in the front side of the nozzle body.

12 Claims, 2 Drawing Sheets

SPRAY HEAD HAVING FLUID METERING SCREWS

BACKGROUND OF THE INVENTION

The invention concerns a spray head, in particular, a spray head for the application and distribution of parting media, cooling media and/or preservation media or the like, to die casting molds, injection molds and/or drop forging molds. The spray head comprises a nozzle body with a nozzle tip and regulating and metering screws for controlling the spray medium and the compressed air. Connections for receiving the spray media and compressed air are provided.

Spray heads of that type are disclosed in German OS-32 38 201, and are used to provide walls of molds (such as used in die casting or injection molding operations) with parting media to facilitate the subsequent removal of the workpiece. Cooling media may be applied similarly by means of spray heads to simplify the temperature control of the molds. It is further known to spray drop forging dies with lubricants, thereby minimizing wear and reducing forging forces. Spray heads of this type have control elements whereby the volume (and therefore the pressure) of both the spray medium and the compressed air may be regulated. The connections for the spray media and compressed air are usually in the form of threaded bores on the circumference of the nozzle body to receive hose or tube screw couplings and also to serve as variable direction holders of the spray head.

To completely spray the molds, it is often necessary to use several spray heads in order, for example, to apply the required quantity of cooling media or to cover a large surface area within the mold. The known spray heads have the disadvantage that due to their radial connections for the spray media and the compressed air, they require much space and thus are ill-suited for the use of several spray heads, as they do not permit tight packing thereof. Furthermore, these spray heads must be accessible from nearly every direction to make possible the manipulation of their regulating and metering elements.

It is, therefore, an object of the invention to provide a spray head of the afore-mentioned type which is controlled in a simple manner and which makes possible a high packing (i.e., high density) of spray heads when several spray heads are used.

SUMMARY OF THE INVENTION

This object is achieved by the present invention which involves a spray head for spraying a spray medium onto molds and dies. The spray head comprises a nozzle body which includes a front side, a rear side, and first and second internal passages for conducting spray medium and compressed air, respectively. Those passages include first and second fluid inlet ports in the rear side to which spray medium and compressed air, respectively, are supplied. A spray nozzle is mounted on the front side for emitting a mixture of spray medium and compressed air received from the first and second passages. A first metering mechanism is provided for controlling the volume of spray medium supplied to the nozzle. That first metering mechanism includes a first metering screw disposed in the body and exposed for adjustment at the front side. A second metering mechanism is provided for controlling the volume of compressed air supplied to the nozzle. The second metering mechanism includes a second metering screw disposed in the body and exposed for adjustment at the front side.

By locating the fluid inlet ports in the rear side of the nozzle body, the feeder lines are conducted longitudinally to the spray body, which results in the advantage that the spray head does not require as much space as in the prior art. Consequently, the spray head may be mounted in a tightly abutting manner against the boundary walls, or several spray heads may be arranged in abutment against each other.

As a result of the fact that the regulating and metering screws are exposed on the front side from which the nozzle tip protrudes, the spray head may be conveniently adjusted for greatly differing applications, even if the spray head is to be used in combination with a plurality of other spray heads or is to be placed in relatively inaccessible locations of the molds to be sprayed themselves.

A simple mounting of the spray head on its holder is made possible because the connections are provided in the form of plug or chuck-type connections for the spray media, spraying air and the control air, wherein the connections may comprise smooth bores. The spray head is mounted by being set against or inserted into a suitably configured holder, and secured by means of appropriate fasteners. The time-consuming and cumbersome screwing-on of hose or tubular lines carrying the spray media is thus eliminated.

The spray head mounted in the holder is sealed against the bores introducing the spray media by equipping the connections of the spray head with individual seals or providing the rear side of the nozzle body with a sealing plate. The individual seals or the sealing plate create a sealed joint of the connections with the bores of the holder introducing the spray media.

A simple fastening of the spray head to a support flange is obtained by at least two fastening screws passing front-to-rear through the spray head and secured to the flange. In practice, the spray head is set onto the flange with the bores of the flange carrying the spray medium aligned with the inlet ports of the spray head. The fastening screws are inserted from the front side of the spray head. This yields the advantage that in the case of several closely arranged spray heads, individual heads may be removed for cleaning, repairs or the like, without having to remove the adjacent spray heads.

As noted earlier, the front side of the nozzle body comprises a spraying air metering screw, a spray media metering screw and fastening screws. Consequently, the metering screws are readily accessible even under tight spatial conditions to make possible the easy adjustment of the spray jet, and the screws are removable for cleaning purposes with the spray head remaining mounted.

Metering of the spray medium can be achieved by a needle valve connected to a piston. The stroke of the piston may be adjusted by the spray medium metering screws by means of an articulated lever located in the nozzle body. Longitudinally movable metering pistons combined with a needle valve are disclosed in previously discussed German OS-32 38 201. These pistons are moved, upon the introduction of control air, from their rest position in which they close the needle valve, into their open position, during which they, traverse a variable stroke path. The needle valve opens a feeder opening of the spray medium conduit, thereby metering the medium to be sprayed. The stroke path and thus the quantity of the spray medium to be sprayed is regulated according to the invention by the spray medium metering screw, the longitudinal motion of which is transferred by means of the articulated lever to a longitudinally adjustable stop for the metering piston.

The nozzle tip can be mounted on the spray head by means of a replaceable nozzle tip holder. This provides the advantage that nozzle tip holders of different configurations may be used, for example, nozzle tip holders operating on internal or external mixing principles. The spray head is thereby provided with a broad range of applications and is capable, depending on the choice of nozzles, of producing a round, oval, linear or any other spray jet, both restricted to a small area, i.e., with an acute spray cone, or one spraying over a large area. The nozzle tip is advantageously in the form of a flexible tube, or it may have a ball-shaped mounting portion which rotates in the body. It is possible in this manner to spray certain target locations and to adjust or reset the spraying direction in a simple manner. Advantageously, the ball may be provided with contact surfaces for a tool, so that it may be rotated or pivoted easily without damage to the nozzle channel.

The cross-section of the spray head is rectangular. In this manner, a high packing density is achieved in the case of the use of several adjacently located spray heads. The spray heads may have different cross-sections, so long as they can be set against each other without the formation of a free interstitial space.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which.

DETAILED DESCRIPTION OF A PREFERRED EMBODIMENT OF THE INVENTION

Figure 1:
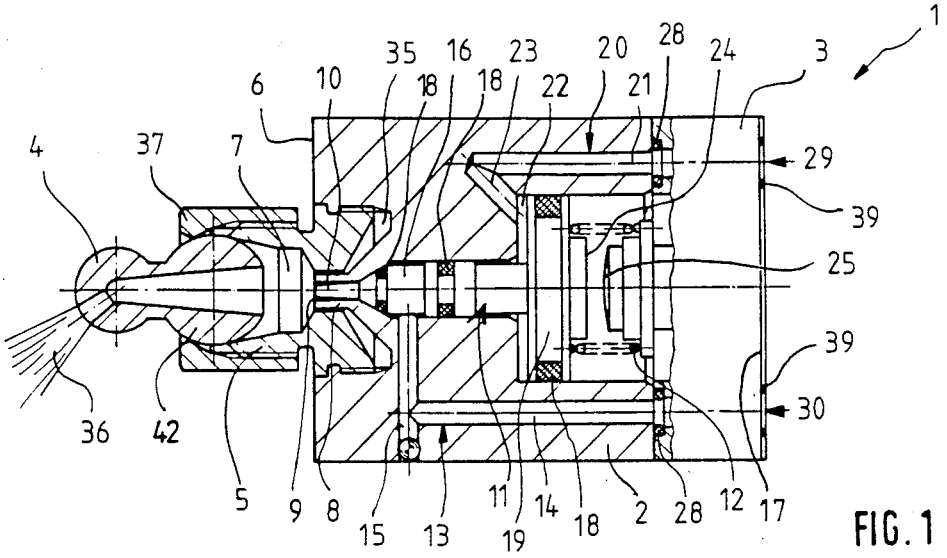
FIG. 1 is a longitudinal sectional view taken through a spray head according to the present invention, the section taken along line I—I in FIG. 3.

The figures show a spray head having a configuration according to the invention, comprising a nozzle body 2 with a removable base plate 3, and a nozzle tip 4 held by a nozzle tip holder 5. The nozzle tip holder 5 is secured in a threaded recess in the front side 6 of the nozzle body. A rear wall of the recess forms, with a conical rear side of the nozzle tip holder, an annular chamber 35 for the compressed air. A cylindrical portion 8 of the body protrudes centrally into the annular chamber 35. The portion 8 contains a bore 9 in which is disposed a needle 10. The needle 10 is connected to a metering piston 11 which is axially movable in the nozzle body 2. The needle and bore together form a needle valve 9, 10, through which the spray medium is dispensed.

The metering piston 11 is held by a compression spring 12 in a valve-closed position, wherein the needle 10 passes through the bore 9 and sealingly closes it. In this position of the piston 11, the spray medium supply line 13, which comprises a longitudinal bore 14 and a radially intersecting bore 15, is closed at the surface of the nozzle body 2. The bore 15 itself is closed by a slide part 16 of the metering piston 11. The piston 11 is supported in a stepped recess. Seals 18 are mounted at both ends of the slide part 16. The metering piston 11 further comprises a control piston part 19. A control air line 20 is arranged to conduct control air to pressure the piston control part 19 rearwardly to open the valve. The air line 20 comprises a longitudinal bore 21 and a bore 23 connecting the bore 21 with a control chamber 22 disposed in front of the control piston part 19.

Figure 2:
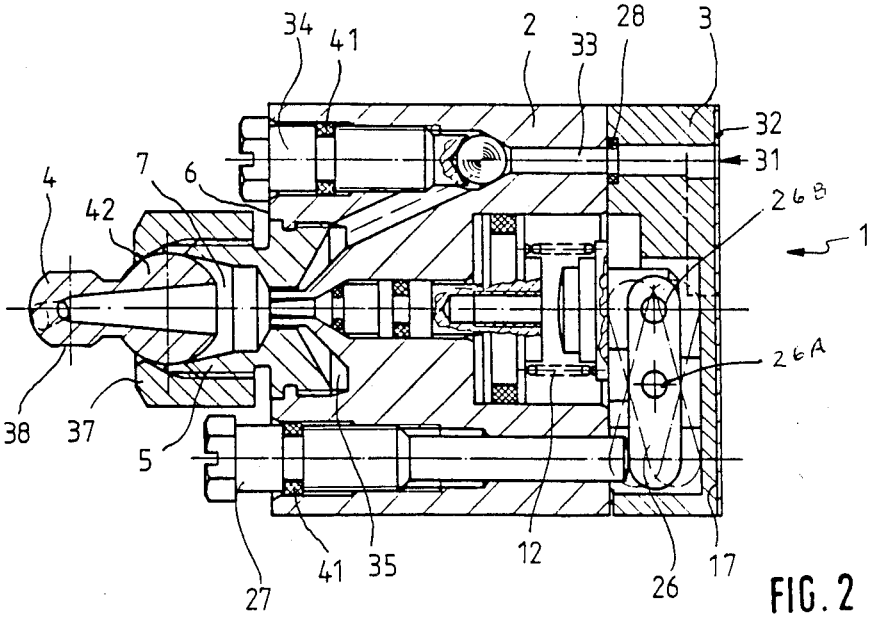
FIG. 2 is a view similar to FIG. 1 but taken along line II—II in FIG. 3.

The rear end 24 of the metering piston 11 abuts in the valve-open position against a stop 25. The stop 25 may be adjusted longitudinally by means of an articulated lever 26, whereby the stroke of the metering piston 11 may be varied. The lever 26 is pivoted at 26A and carries a pin 26B which is received in an opening of the stop 25. That opening is preferably in the form of a rearwardly open slot which permits easy removal of the link 26. The opposite end of the link engages the rear end of a spray medium metering screw 27. The stop 25 is adjusted by means of the spray medium metering screw 27 arranged longitudinally and exposed at the front side 6 The screw 27 acts on the articulated lever 26 in such manner that the screwing-in of the metering screw 27 produces a longitudinal forward adjustment of the stop 25 toward the metering piston 11 thereby shortening the stroke of the piston. In FIG. 2, the articulated lever 26 is also indicated by a broken line to make clear how it translates the axial movement of the metering screw 27 into an axial motion of the stop 25, whereby the stroke length of the piston 11 is adjusted. The spring 12 forces the stop 25 into frictional contact with the lever 26 and the latter into contact with the metering screw 27. Therefore, no relative play or lost motion occurs between the screw 27 and the stop 25.

Advantageously, the lever 26 is pivoted to the removable base plate 3 so that by the simple replacement of a base plate 3 with another base plate carrying a lever 26 with different lever arm lengths, the adjusting distance of the stop 25 may be set in a finer or a coarser manner. The base plate 3 carries 0-ring seals 28 which surround various fluid passages for air and spray medium. The metering piston 11 may be withdrawn from the nozzle body 2 by means of a pulling tool screwed axially into a rear end 24 of the piston 11.

The nozzle body 2 has connections 29, 30, 31 through which are introduced the piston control air, the spray media, and the spraying air. The connections 29–31 comprise smooth bores which carry seals, for example, in the form of sealing plates 32, which when the nozzle body 2 is in a mounted condition, is located between the seat (not shown) and the base plate 3. Each of the connections 29–31 includes an inlet port located in the rear side 17 of the nozzle body 2.

The body 2 also contains a spraying and blowing air line 33, whereby the spraying air may be introduced into the annular chamber 35 and thence into a mixing space 7. Compressed air is metered by means of a longitudinal metering screw 34 located axially relative to the nozzle body 2, which is exposed at the front side 6. The metering screws 27, 34 are sealed from the atmosphere by means of seals 41.

If the connection 29 is placed under pressure by control air, the metering piston 11 is moved rearwardly against the force of spring 12 by a distance or stroke path defined by the stop 25, the stroke path having been set by the spray medium metering screw 27. In the process, the slide part 16 opens the spray medium line 13 and the needle 10 is retracted from the bore 9, whereby the flow of spray media into the mixing space 7 is made possible. The volume of the flow depends on the position of the metering piston 11 and its stroke length. The atomization of the spray medium introduced is effected by the injection of compressed air, which is introduced through the connection 31 into the spraying air line 33 and arrives through the annular chamber 35 in the mixing space 7, while being controlled by the screw 34. In the process, the compressed air completely surrounds the incoming spray medium, thereby providing complete atomization.

The nozzle tip holder 5 could also have a configuration such that the spraying air is blown directly into the mixing space 7 rather than indirectly via the annular chamber 35. The spray head 2 may therefore be operated both by the internal and the external mixing principle.

An easy adjustment of the spray jet 36 may be obtained by configuring the nozzle tip 4 in the form of a ball which is rotatable in the nozzle tip holder 5. The nozzle tip 4 is secured against rotation in its seat by a union nut 37. A slight loosening of the union nut 37 renders the ball 42 both rotatable about a longitudinal axis and pivotable about a transverse axis, so that the spray jet 36 may assume any direction desired. The nozzle tip 4 may be replaced by another if a spray jet 36 of a different shape or with a different angle of opening is required. The nozzle tip may contain contact surfaces 38 for a tool, so that any rotation or pivoting thereof may be carried out without difficulty.

Figure 3:
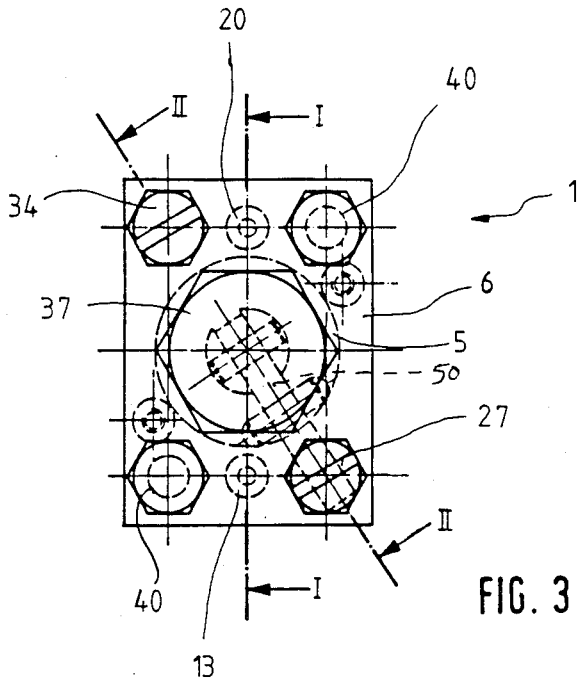
FIG. 3 is a front elevational view of the spray head.

Instead of a nozzle tip 4 in the form of a ball 42, a flexible tube 50 (FIG. 3) could be mounted in the nozzle tip holder 5, providing the advantage that the regions of the casting molds or dies to be sprayed may be closely targeted. In FIG. 3 the front end of the spray head 11 is shown in which its rectangular cross-section is clearly visible. The spray medium metering screw 27 and the spraying air metering screw 34 are also seen, together with the afore-mentioned flexible tube (shown in broken lines) held by the union nut 37 in the nozzle tip holder 5.

The fastening screws 40 serve to secure the spray head 1 against a flange. The screws could be held in the body 2 in such manner as to avoid being lost. The locations of the control air line 20 and the spray medium line 13 are also indicated in FIG. 3.

In accordance with the present invention there is provided a spray head in which the various components and fluid passages are effectively arranged to produce a highly compact structure. The metering screws 27, 34 are readily accessible, so the volumes of spray media and compressed air can be easily adjusted. Also, the fastening screws 40 are readily accessible to facilitate repair or replacement of the spray head. The 0-rings 41 act simultaneously as seals and as means yieldably resisting rotation of the screws 27, 34 whereby accidental rotation thereof is guarded against.

By locating the fluid inlet ports in the rear side of the nozzle body, the feeder lines thereof are conducted longitudinally to the spray body, whereby the spray head does not require as much space as conventional spray heads. Therefore, each spray head can be mounted closer to adjoining walls, or several spray heads may be arranged very closely together.

Because the metering screws are exposed on the front side of the nozzle body, it is very easy to adjust those screws no matter where the spray heads are located.

The spray head can be easily mounted to a support flange by simply abutting the rear side against such flange and tightening the screws 40.

The metering mechanism for the spray medium makes advantageous use of a pivotably mounted lever for transmitting longitudinal movement from the metering screw to the piston stop.

The nozzle tip can assume various shapes and forms and can be adjusted to spray in many different directions.

It will be appreciated that the use of the term longitudinally in the foregoing description relates to a direction parallel to the front-to-rear axis of the spray head.

Although the present invention has been described in connection with a preferred embodiment thereof, it will be appreciated by those skilled in the art that additions, modifications, substitutions and deletions not specifically described may be made, without departing from the spirit and scope of the invention as defined in the appended claims.

What we claim is:

1. A spray head for spraying a spray medium onto molds and dies, comprising:

a nozzle body including:

a front side, a rear side, and first and second internal passage means for conducting spray medium and compressed air, respectively, and including first and second fluid inlet ports in said rear side to which spray medium and compressed air are supplied, a spray nozzle mounted on said front side for emitting a mixture of spray medium and compressed air received from said first and second passage means, first metering means for controlling the volume of spray medium supplied to said nozzle and including a spray control valve, a reciprocable piston operably connected to said valve for opening and closing said valve, a stop reciprocable toward and away from said piston for adjusting the stroke length thereof, a first metering screw disposed in said body and exposed for adjustment at said front side, and actuating means for displacing said stop in response to rotation of said first metering screw, said actuating means arranged such that one end thereof acts against said stop and an opposite end thereof is engaged by said first metering screw, and second metering means for controlling the volume of compressed air supplied to said nozzle and including a second metering screw disposed in said body and exposed for adjustment at said front side.

2. Apparatus according to claim 1, wherein said inlet ports comprise smooth bores.

3. Apparatus according to claim 1 including sealing means for sealing around inlet ends of said ports.

4. Apparatus according to claim 1 including at least two fastening screws passing through said body for fastening said body to a support, said screws extending from said front side to said rear side and being exposed for actuation at said front side.

5. Apparatus according to claim 1 including a replaceable holder mounted in said front said, said nozzle being carried by said holder.

6. Apparatus according to claim 1, wherein said nozzle includes a ball-shaped mounting portion rotatably mounted in said front side.

7. Apparatus according to claim 1, wherein said nozzle comprises a flexible tube.

8. Apparatus according to claim 1, wherein said body is rectangular in cross-section.

9. Apparatus according to claim 1, wherein said actuating means includes a pivotably mounted member.

10. Apparatus according to claim 9, wherein said pivotably mounted member comprises a lever pivotably mounted between said ends.

11. Apparatus according to claim 9 including a spring acting to bias said piston forwardly and bias said stop rearwardly against said lever.

12. Apparatus according to claim 11 including third passage means in said body for conducting compressed air to actuate said piston in one direction of its reciprocation, said third passage means including a third inlet port in said rear surface.

* * * * *